US007188379B2

(12) United States Patent
James et al.

(10) Patent No.: US 7,188,379 B2
(45) Date of Patent: Mar. 13, 2007

(54) COMBINATION AIR AND SPRING MATTRESS FOR A SOFA SLEEPER

(75) Inventors: Keith James, Carl Junction, MO (US); Dennis Arft, Joplin, MO (US)

(73) Assignee: L & P Property Management Company, South Gate, CA (US)

( * ) Notice: Subject to any disclaimer, the term of this patent is extended or adjusted under 35 U.S.C. 154(b) by 13 days.

(21) Appl. No.: 11/057,906

(22) Filed: Feb. 15, 2005

(65) Prior Publication Data

US 2006/0179566 A1 Aug. 17, 2006

(51) Int. Cl.

| | |
|---|---|
| ***A47C 17/04*** | (2006.01) |
| ***A47C 27/04*** | (2006.01) |
| ***A47C 27/08*** | (2006.01) |
| ***A47G 9/02*** | (2006.01) |

(52) U.S. Cl. ..... 5/12.1; 5/13; 5/706; 5/716; 5/727; 5/737

(58) Field of Classification Search ..... 5/12.1, 5/13, 18.1, 706, 644, 654, 655.3, 716, 717, 5/722, 727, 737–739

See application file for complete search history.

(56) References Cited

U.S. PATENT DOCUMENTS

| | | | | | |
|---|---|---|---|---|---|
| 1,528,066 | A | * | 3/1925 | McEntire | 5/722 |
| 2,779,034 | A | * | 1/1957 | Arpin | 5/697 |
| 2,814,053 | A | * | 11/1957 | Sevcik | 5/706 |
| 4,169,295 | A | * | 10/1979 | Darling | 5/706 |
| 4,213,214 | A | * | 7/1980 | Gilhooly | 5/679 |
| 4,224,706 | A | * | 9/1980 | Young et al. | 5/710 |
| 4,286,344 | A | * | 9/1981 | Ikeda | 5/717 |
| 4,306,322 | A | * | 12/1981 | Young et al. | 5/706 |
| 4,357,724 | A | * | 11/1982 | Laforest | 5/706 |
| 4,442,556 | A | * | 4/1984 | Craigie | 5/13 |
| 4,462,129 | A | * | 7/1984 | Brannock | 5/717 |
| 4,694,515 | A | * | 9/1987 | Rogers, Jr. | 5/13 |
| 4,712,261 | A | * | 12/1987 | Castro | 5/499 |
| 4,782,540 | A | | 11/1988 | Parker | |
| 4,827,546 | A | * | 5/1989 | Cvetkovic | 5/665 |
| 5,105,488 | A | * | 4/1992 | Hutchinson et al. | 5/710 |
| 5,107,558 | A | | 4/1992 | Lück | |
| 5,113,539 | A | * | 5/1992 | Strell | 5/710 |
| 5,421,044 | A | * | 6/1995 | Steensen | 5/710 |
| 5,636,396 | A | * | 6/1997 | Workman et al. | 5/717 |
| 6,006,383 | A | * | 12/1999 | Pile et al. | 5/706 |
| 6,098,223 | A | | 8/2000 | Larson | |
| 6,108,844 | A | * | 8/2000 | Kraft et al. | 5/732 |
| 6,161,231 | A | * | 12/2000 | Kraft et al. | 5/710 |
| 6,317,912 | B1 | * | 11/2001 | Graebe et al. | 5/710 |
| 6,463,610 | B1 | | 10/2002 | Shulte et al. | |

(Continued)

*Primary Examiner*—Robert G. Santos
(74) *Attorney, Agent, or Firm*—Shook, Hardy & Bacon, L.L.P.

(57) ABSTRACT

This invention is directed to a mattress assembly for use in a sofa sleeper. The mattress assembly has an outer shell and an inner support received within the outer shell. The shell includes a lower panel, a sidewall, and a cover that fit together to form a cavity to receive the inner support. The inner support includes an air bladder and an innerspring portion. The air bladder has a valve that is adapted to allow air into and out of the bladder. The air bladder is deflated when the mattress is stored to provide a compact configuration.

21 Claims, 3 Drawing Sheets

U.S. PATENT DOCUMENTS

| | | | | |
|---|---|---|---|---|
| 6,665,893 | B2 | 12/2003 | Frugé | |
| 6,745,420 | B2 | 6/2004 | Giori et al. | |
| 6,763,540 | B1 | 7/2004 | Wang | |
| 6,857,142 | B2 * | 2/2005 | Fruge | 5/12.1 |
| 6,986,182 | B2 * | 1/2006 | Mossbeck | 5/727 |
| 7,127,761 | B2 * | 10/2006 | Fruge | 5/706 |
| 2002/0133883 | A1 | 9/2002 | Perez et al. | |
| 2003/0135930 | A1 | 7/2003 | Varese et al. | |
| 2004/0010855 | A1 | 1/2004 | Piraino | |
| 2004/0073999 | A1 | 4/2004 | Frugé | |
| 2004/0074008 | A1 | 4/2004 | Martens et al. | |
| 2004/0139551 | A1 | 7/2004 | Wang | |
| 2005/0273939 | A1 * | 12/2005 | Mossbeck | 5/720 |
| 2006/0179566 | A1 * | 8/2006 | James et al. | 5/12.1 |

* cited by examiner

COMBINATION AIR AND SPRING MATTRESS FOR A SOFA SLEEPER

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates generally to a mattress for a sofa sleeper and, more particularly, to a mattress with an inner support material that contains both an innerspring construction and an air bladder, whereby the air bladder may be deflated for easy storage of the mattress within the sofa sleeper.

Traditional sofa sleepers are designed to be used as both a sofa and a bed. The sofa sleepers are designed with a folding frame mechanism that allows for storage of the mattress when the unit is used as a sofa. Thus, when the user of the bed wishes to stow the mattress, the foot portion of the bed is folded upwardly over the mattress. In this position the foot portion of the mattress is folded over the middle portion of the mattress. It is well known that mattresses provided with a sofa sleeper can be difficult to fold for storage within the unit. This is due to the space constraints existing within the sofa sleeper as well as the internal design of the mattress. Typically, the mattress used in a sofa sleeper contains an internal spring configuration. If a conventional sofa sleeper size mattress is used, the folded mattress when stored is bulky and, thus, the fit and function of the sofa is compromised. The difficulty in storage arises due to the reluctance of the internal spring configuration to compress when folded. Thus, the available space within the sofa sleeper for the mattress when the mattress is in a stowed condition and the reluctance of a spring mattress to fold necessitates a mattress that is relatively thin. However, when a thin mattress is used, the person sleeping on the mattress may often feel the support frame through the mattress. Additionally, after the internal spring mattress is folded and stored, the springs may come in contact with one another, leading to problems of noise when in use. Moreover, the compression of the folded springs creates a "hard" seating surface, as opposed to conventional stationary furniture. Thus, it would be desirable to manufacture a conventional sofa sleeper sized mattress that fits within the space constraints of a sofa sleeper, while also providing increased comfort for the individual sleeping thereon or sitting thereon, including enhanced seating comfort via reduced spring overlap in the stowed condition.

Additionally, while mattresses for sofa sleepers are known, there remains a need for an improved conventional sized mattress for a sofa sleeper with increased comfort when used as a bed while providing the same form and fit of a traditional sofa when the mattress is folded for storage.

BRIEF SUMMARY OF THE INVENTION

This invention is directed to a mattress for use in a sofa sleeper. The mattress contains a shell and an inner support. The shell includes a lower panel, a sidewall portion, and a cover. The lower panel, sidewall portion, and cover fit together to form a cavity to receive the inner support material. The inner support material includes both an innerspring portion and an air bladder portion. The air bladder portion has a valve apparatus, which is adapted to selectively allow air into and out of the air bladder.

The air bladder and innerspring portions are configured to provide the support of a conventional mattress while also allowing for easy folding during storage. This is accomplished due to the fact that the air bladder may be deflated when not in use. The air bladder portion once deflated is relatively thin. Thus, when the innerspring portion is folded onto the deflated air bladder portion, the resulting configuration is compact. Moreover, the location of the spring portion allows the sofa sleeper to have the feel of a conventional sofa for a person sitting thereon. Thus, inherent nature of the folded mattress when stored and the positioning of the innerspring portion, provides a seating surface that retains the form and fit of a conventional sofa.

BRIEF DESCRIPTION OF THE SEVERAL VIEWS OF THE DRAWING

These and other objectives and advantages of the present invention will be more readily apparent from the following detailed description of the drawings of the preferred embodiment of the invention that are herein incorporated by reference and in which.

DETAILED DESCRIPTION OF THE INVENTION

Figure 1:
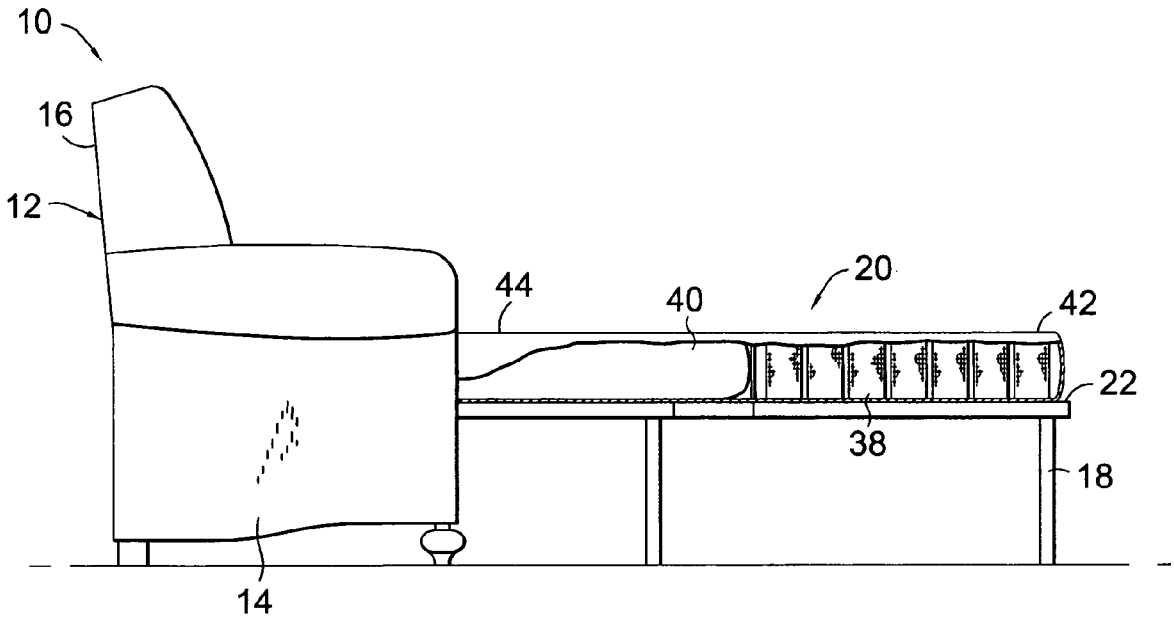
FIG. 1 is a side elevation view of a sofa sleeper according to the present invention, with the mattress in the deployed position and with parts broken away to show details of construction.
Figure 2:
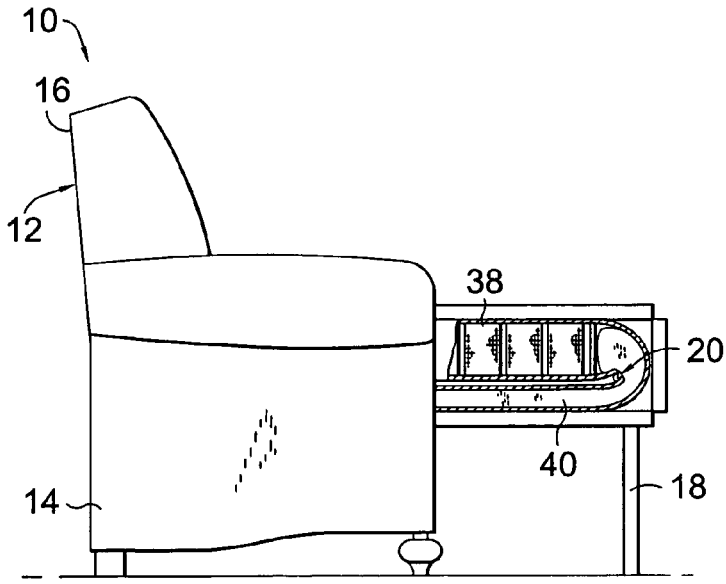
FIG. 2 is a view similar to FIG. 1, but with the sofa sleeper in the partially stored position.
Figure 3:
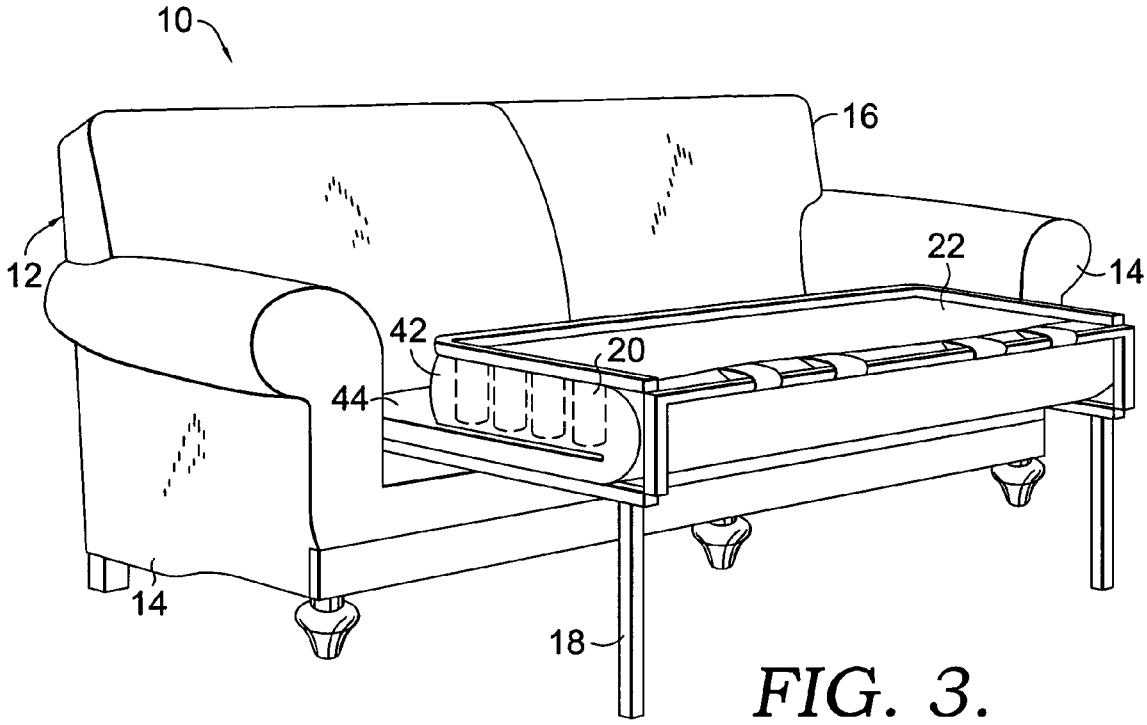
FIG. 3 is a perspective view of the sofa sleeper of FIG. 2.

With initial reference to FIGS. 1–3, a sofa sleeper according to the principles of the present invention is designated generally with the reference numeral 10. Throughout this specification, the term sofa sleeper is also intended to encompass love seats and other smaller units. The sofa sleeper 10 is constructed with a sofa frame 12, which includes a pair of arms 14 and a back 16. The sofa sleeper 10 has a mattress frame 18 coupled thereto. The mattress frame 18 is any one of a number of existing frames available and known to those of skill in the art. The mattress frame 18 is attached to the sofa frame 12 in a manner well known in the art and operates to move a mattress 20 from the deployed position shown in FIG. 1, to the folded position of FIGS. 2 and 3, and to the stored position, not shown, when sofa sleeper 10 is used as a sofa.

Figure 4:
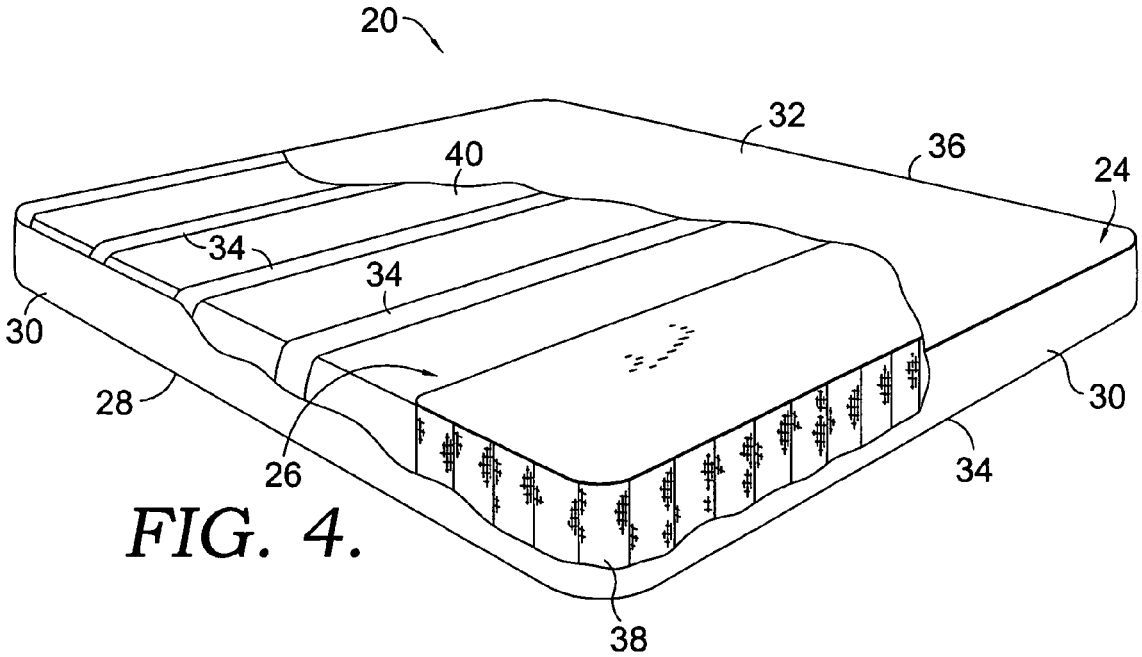
FIG. 4 is a perspective view of the mattress in the deployed position with a portion of the cover removed.
Figure 5:
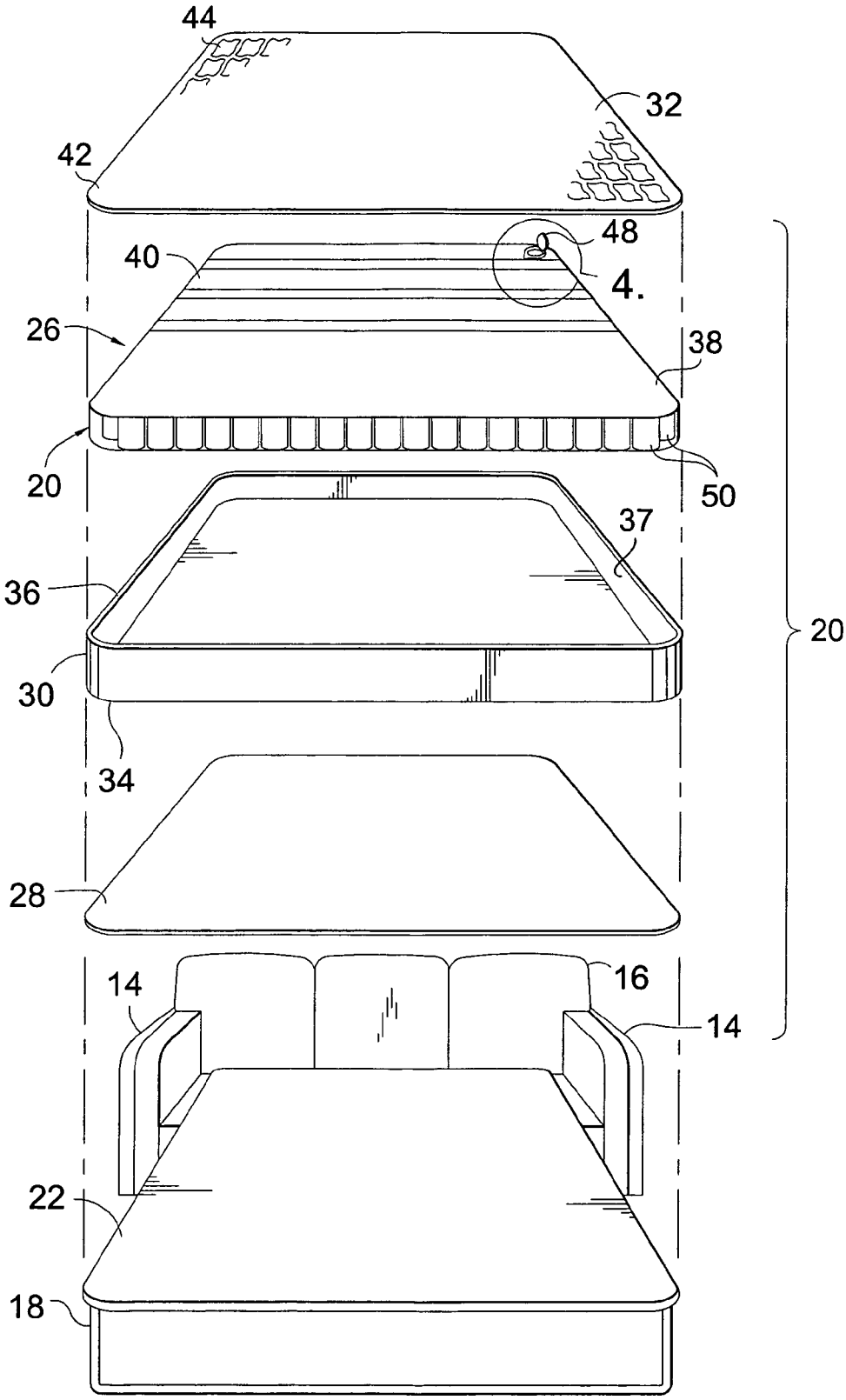
FIG. 5 is a front exploded view of the mattress and the sofa sleeper of FIG. 1.

As best seen in FIG. 1, the mattress 20 rests upon a support surface 22 provided as part of the mattress frame 18. As is understood by one of ordinary skill in the art, the support surface 22 can be provided in a number of ways, some examples include a number of springs attached to the mattress frame 18 and a resilient fabric material. Referring now to FIGS. 4 and 5, the mattress 20 includes a shell 24 and an inner support 26. The shell 24 includes a lower panel 28, a sidewall 30, and a cover 32. The lower panel 28 rests on the support surface 22. The sidewall 30 contains a lower edge 34, an upper edge 36, and an inner wall 37. The sidewall 30 is attached on its lower edge 34 to the lower panel 28 and extends around its perimeter. The cover 32 is attached to the upper edge 36 of the sidewall 30. As is understood by one of ordinary skill in the art, the shell 24 consisting of the lower panel 28, the sidewall 30, and the cover 32 fit together to form a cavity to receive the inner support 26. Further, it will be appreciated by one of ordinary skill in the art that any attachment method for the cover could be used, such as a zipper, stitching, sewing or the like. In one embodiment, the sidewall 30 has a zipper, not shown, attached on its upper edge 36 that is used to removably couple the cover 32 to the sidewall 30. This embodiment provides a cover 32 that is removably attached so that the user has direct access to the inner support 26. In another embodiment, the cover 32 is attached to the upper edge 36 of the sidewall 30 by stitching or sewing. This embodiment provides a permanent enclosure where the user will not have direct access to the inner support 26.

As shown with further reference to FIGS. 4 and 5, the inner support 26 is received within the shell 24. The inner support 26 broadly includes an innerspring portion 38 and an air bladder portion 40, both portions having a height comparable to a conventional sofa mattress. As is apparent to one of ordinary skill in the art, the mattress 20 further contains a foot end 42 and a head end 44. The innerspring portion 38 is generally located at the foot end 42 of the mattress 20 while the air bladder portion 40 is located at the head end 44. The innerspring portion 38 is sized to correspond to the seating depth of the sofa 10 when the mattress 20 is folded for storage. As best seen in FIGS. 1 and 4, the innerspring portion 38 abuts the air bladder portion 40 to form a continuous support surface for the user when the mattress 20 is in the deployed position. The innerspring portion 38 of the mattress 20 is any one of a number of existing innerspring configurations available and known to one of ordinary skill in the art. As an example, innerspring portion 38 can be a pocketed coil.

The air bladder portion 40 is preferably made from a durable, air impermeable material, such as vinyl. The air bladder 40 may be one of a number of existing bladders currently available and known to one of ordinary skill in the art. The air bladder 40 includes a valve 48 that is integrally formed therein. The valve 48 is sized to accommodate an inflating pump, not shown that may be either external or internal to the bladder 40. In either configuration, the pump can contain a reversible deflation feature and/or a dump valve release system. Both the valve 48 and the pump are also conventional items known to one of ordinary skill in the art. Further, while the valve 48 is shown in FIG. 5 in the upper corner, the placement of the valve 48 is not material to the discussion. It will be appreciated by one of ordinary skill in the art that the valve 48 may be located in the air bladder 40 when the cover 32 is removably attached with a zipper, as discussed above. This embodiment would provide access to the valve 48 by opening the zipper. Additionally, it is also understood that the valve 48 may extend through the shell 24 for outside access if the cover 32 and, thus, the shell 24 are permanently sealed.

As shown in FIG. 4 the shell 24 also contains a plurality of internal elastomeric elements 34. The elastomeric elements 34 are bands made from a stretchable, elastic material. As is understood by one of ordinary skill in the art any suitable elastomeric material may be used. The elastomeric elements 34 are attached on opposed sides of the inner wall 37 of the sidewall 30 and extend transversely across the inner support 26 of the mattress 20. It will be appreciated by one of ordinary skill in the art that any suitable attachment method may be used, such as sewing or stitching. The elastomeric elements 34 are attached to the sidewall 30 in tension. The tensile connection of the elastomeric elements 34 pulls the sidewall 30 inwardly toward the center of the mattress 20 and serves to maintain the structural integrity of the sidewall 30 when the mattress 20 is folded for storage. More specifically, the elements 34 pull the sidewalls 30 inwardly, preventing the shell 24 from unwanted interference with the linkage of the frame 18.

Referring again to FIGS. 1–3, the operation of the sofa sleeper 10 will now be discussed. FIG. 1 illustrates the sofa sleeper 10 in the deployed position, wherein the mattress 20 is useful as a sleeping surface. The air bladder portion 40 of the mattress 20 is inflated and the air bladder portion 40 and the innerspring portion 38 abut to provide a continuous support surface for the user. FIGS. 2 and 3 illustrate the sofa sleeper 10 in the intermediate-folded position, wherein the mattress 20 is ready to be stored. The air bladder portion 40 of the mattress 20 is deflated and the innerspring portion 38 has been folded and is resting on the deflated air bladder portion 40. From this position, the frame 18 is further lifted and pushed inwardly to fully stow the mattress. In the fully stowed position, the innerspring portion 38 provides a support for the cushions of the sofa sleeper. Because the innerspring portion 38 is shaped and sized similarly to the support portion of a traditional sofa, innerspring portion 38 a support closely resembling the feel of a traditional sofa.

To place the sofa sleeper 10 in a position for sleeping, the cushions of the sofa are removed and the frame 18 is pulled from within the sofa sleeper to the position shown in FIGS. 2 and 3. In this position the air bladder portion 40 is deflated. Next, the user unfolds the frame 18 by pulling the foot end 42 of mechanism 18, including attached mattress 20, from its resting position on top of the head end 44 of the mattress 20. The sofa 10 is now in the deployed position as shown in FIG. 1. The description that follows takes into account an inner support 26 that is enclosed by a shell 24 with a removable cover 32 as described above. Referring now to FIG. 5, the zipper, not shown, is used to expose the valve 48 as is understood by one of ordinary skill in the art. The pump, not shown, is engaged with the valve 48 and the air bladder portion 40 is inflated. When the air bladder portion 40 is fully inflated the pump is disengaged and the cover 32 is then re-zipped to hide the valve 48. The sofa sleeper 10 in this position is ready for sleeping.

When the mattress assembly 20 is to be stowed within sofa sleeper 10, the zipper, not shown, is used to expose the valve 48. The valve 48 is then opened, allowing air to escape from the bladder 40. Once the air is removed from the bladder 40, the cover 32 is then re-zipped. As shown in FIGS. 2 and 3, the foot end 42 is folded over the head end 44 so that the innerspring portion 38 of the mattress 20 rests on the deflated air bladder portion 40. The mattress 20 is now in the folded position wherein the mattress is ready to be stored within the sofa sleeper 10.

The present invention has been described in relation to particular embodiments, which are intended in all respects to be illustrative rather than restrictive. Alternative embodiments will become apparent to those skilled in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated and within the scope of the claims.

What is claimed is:

1. A mattress for use in a sofa sleeper and adapted to be folded within the sofa sleeper, comprising:

a shell; and an inner support received within the shell, said inner support including at least first and second compartments, said first compartment having an innerspring construction and said second compartment having an air bladder each compartment being located externally to the other compartment within the shell and wherein respective top surfaces of the first and second compartments are substantially disposed in a common horizontal plane when the mattress is configured to a substantially fully extended position.

2. The mattress of claim 1 further including a foot portion and a head portion, wherein the innerspring construction is located at the foot portion.

3. The mattress of claim 2, wherein the air bladder is located at the head portion.

4. The mattress of claim 3, wherein the air bladder has a valve adapted to selectively allow air into and out of the air bladder.

5. The mattress of claim 1, wherein the shell includes a lower panel, a sidewall coupled to an edge of the lower panel and extending upwardly therefrom, and a top cover removably coupled to the sidewall, the top cover, lower panel, and sidewall forming a cavity for receipt of the inner support.

6. The mattress of claim 5, further including at least one elastomeric element coupled to opposed sides of an inner wall of the sidewall, wherein the at least one elastomeric element extends transversely across the inner support.

7. The mattress of claim 6, wherein the at least one elastomeric element is pretensioned.

8. The mattress of claim 7, wherein the at least one elastomeric element is an elastic band.

9. The mattress of claim 5, wherein the top cover is coupled to the sidewall portion by a zipper extending substantially all the way around a top edge of the sidewall.

10. A sofa sleeper, comprising:

a sofa frame having a back and a pair of opposed arms; and a sleeper assembly coupled to the sofa frame, the sleeper assembly including:

a mattress frame that folds into and out of the sofa frame, the mattress frame extendable into a position to provide a sleeping support surface; and a mattress assembly having:

a shell; and an inner support received within the shell, said inner support including at least first and second compartments, said first compartment having an innerspring construction and said second compartment having an air bladder each compartment being located externally to the other compartment within the shell and wherein respective top surfaces of the first and second compartments are substantially disposed in a common horizontal plane when the mattress is configured to a substantially fully extended position.

11. The sofa sleeper of claim 10, wherein the mattress includes a foot portion and a head portion, the innerspring construction being located at the foot portion.

12. The sofa sleeper of claim 11, wherein the air bladder is located at the head portion.

13. The sofa sleeper of claim 12, wherein the air bladder has a valve adapted to selectively allow air into and out of the air bladder.

14. The sofa sleeper of claim 10, wherein the shell includes an inner panel, a sidewall coupled to an edge of the inner panel and extending upwardly therefrom, and a top cover removably coupled to the sidewall, the top cover, inner panel, and sidewall forming a cavity for receipt of the inner support.

15. The sofa sleeper of claim 14, further including at least one elastomeric element coupled to opposed sides of an inner wall of the sidewall, wherein the at least one elastomeric element extends transversely across the inner support.

16. The sofa sleeper of claim 15, wherein the at least one elastomeric element is pretensioned.

17. The sofa sleeper of claim 16, wherein the at least one elastomeric element is an elastic band.

18. The sofa sleeper of claim 14, wherein the top cover is coupled to the sidewall with a zipper extending substantially all the way around the top edge of the cover border.

19. A sidewall maintenance device for use with a mattress having an outer shell and an inner support received within the shell, the shell including a lower panel, a sidewall coupled to an edge of the lower panel and extending upwardly therefrom, and a cover removably coupled to the sidewall, the cover, lower panel, and sidewall forming a cavity for receipt of the air bladder, the device including at least one elastomeric element coupled to opposed sides of an inner wall of the sidewall portion in tension thereby substantially pulling the sidewall toward a center of the shell, wherein the at least one elastomeric element extends transversely across the inner support.

20. The sidewall maintenance device of claim 19, wherein the at least one elastomeric element is pretensioned.

21. The sidewall maintenance device of claim 20, wherein the at least one elastomeric element is an elastic band.

* * * * *